US005582253A

United States Patent [19]

Fraser

[11] Patent Number: 5,582,253

[45] Date of Patent: Dec. 10, 1996

[54] DEBRIS BARRIER WITH A DOWNHOLE TOOL SETTING ASSEMBLY

[75] Inventor: James M. Fraser, Spring, Tex.

[73] Assignee: Baker Hughes Incorporated, Houston, Tex.

[21] Appl. No.: 459,396

[22] Filed: Jun. 2, 1995

[51] Int. Cl.[6] ..... E21B 23/03

[52] U.S. Cl. ..... 166/387; 166/208

[58] Field of Search ..... 166/387, 382, 166/194, 348, 125, 208, 240

[56] References Cited

U.S. PATENT DOCUMENTS

| | | | |
|---|---|---|---|
| 4,726,425 | 2/1988 | Smith, Jr. | 166/387 |
| 4,848,469 | 7/1989 | Baugh et al. | 166/382 |
| 4,942,924 | 7/1990 | Duncan | 166/382 X |
| 5,318,131 | 6/1994 | Baker | 166/382 |
| 5,404,955 | 4/1995 | Echols, III et al. | 166/382 |
| 5,411,099 | 5/1995 | Braddick | 166/387 |
| 5,462,121 | 10/1995 | Schmuck et al. | 166/387 X |
| 5,472,055 | 12/1995 | Simson et al. | 166/382 |

OTHER PUBLICATIONS

George Telfer, et al., *Floating junk bonnet protects liner top debris*, Oil and Gas Journal, Sep. 12, 1994, pp. 79–85.

*Primary Examiner*—Frank Tsay
*Attorney, Agent, or Firm*—Rosenblatt & Redano, PC

[57] ABSTRACT

An apparatus is disclosed to allow efficient setting and release from a liner packer connected to a liner assembly. The polished bore adjacent the packer is protected from debris since the setting procedure takes place while the polished bore remains protected. Movements necessary to accomplish the setting procedure occur principally at the uphole end of the polished bore to minimize adverse effects on the integrity of the polished bore from such movements in an area where subsequent operations require a sealing contact.

26 Claims, 6 Drawing Sheets

DEBRIS BARRIER WITH A DOWNHOLE TOOL SETTING ASSEMBLY

FIELD OF THE INVENTION

The field of this invention relates to downhole tool setting systems, particularly to systems for setting liner packers.

BACKGROUND OF THE INVENTION

A prior system for setting liner hangers is illustrated in FIG. 1 and 2. Such a typical assembly would involve a set shoe 10, a landing collar 12, and a liner 14. At the upper end of the liner string is a liner hanger 16, and above the liner hanger 16 is a packer 18. The packer 18 is actuated to contact the casing, illustrated schematically by dashed line 20. The liner hanger 16 and the packer 18 are ultimately secured to the casing 20 to complete the connection. Connected to the packer 18 is a honed bore 22. The assembly of FIG. 1 is insertable into honed bore 22 shown in FIG. 2. The liner hanger 16 is settable using hydraulic cylinder 24, while the packer 18 is settable with packer setting assembly 28. The particular system illustrated in FIGS. 1 and 2 further included a packer setting assembly 28, which has a plurality of spring-loaded dogs 30. Above the packer setting assembly 28 was a junk cover 32. A lift nipple 34 was at the top of the setting string and used for connection from the surface for manipulation of the setting tool assembly illustrated in FIG. 1 when inserted into the polished bore 22 illustrated in FIG. 2.

The setting assembly shown in FIG. 1 is inserted into the wellbore with the liner assembly shown in FIG. 2 in a fully assembled condition. The junk cover 32 and packer setting assembly 28 are at that time disposed within polished bore 22. Various preparatory activities for cementing may be occurring in the wellbore and the junk cover 32 is disposed in polished bore 22 to keep debris from entering polished bore 22. Thereafter, prior to initiating the cementing operations, it is necessary to know that the setting string shown in FIG. 1 can be readily manipulated with respect to the liner string shown in FIG. 2 after the liner hanger 16 has been set against casing 20. Part of the procedure in the design of FIGS. 1 and 2 has been to raise the setting string shown in FIG. 1 so that the junk cover 32 comes out of polished bore 22 and the dogs 30 exit polished bore 22 so that they can spring outwardly and use end 36 as a support point for packer setting assembly 28. When that occurs, the packer 18 can be set. Several problems occur because of this procedure. First, by taking the junk cover 32 out of polished bore 22, the end 36 of polished bore 22 is opened up to the wellbore, thus making it possible for debris to enter polished bore 22. Another scenario that could lead to the junk cover 32 coming out of polished bore 22 was the pressure placed on setting string in FIG. 1. During the cementing process, upward reaction forces can be exerted on the setting tool assembly shown in FIG. 1 to the point where during cementing, the junk cover 32 exits bore 22, thus allowing foreign matter to get into polished bore 22. The debris could trap the setting tool assembly in the packer, causing expensive retrieving (fishing) and possibly well abandonment. The problem with foreign matter in polished bore 22 is that subsequent operations after the setting assembly of FIG. 1 is removed are necessary. Those subsequent operations depend on being able to obtain a sealing engagement with polished bore 22, which is connected to the packer 18. Additionally, the packer 18 may be a retrievable type which will require subsequent operation of internal components which may become inoperative if fouled with debris. Thus, the removal of the junk cover, for whatever reason, from the bore 22 gives debris a chance to enter bore 22 and foul or plug it or, alternatively, to scratch the polished surface, thereby making it difficult and in some cases impossible to obtain a sealing contact with bore 22 for subsequent operations with equipment thereafter lowered into bore 22. Another factor that adversely affected the ability of subsequent equipment lowered into bore 22 to seal in the bore was the upward movement of the setting string shown in FIG. 1, which resulted in the spring-biased dogs 30 riding against polished bore 22. This upward and/or rotational movement of the setting string of FIG. 1 and dragging of the dogs 30 created longitudinal and/or spiral scratches, which also potentially adversely affected the ability of seals to seal against bore 22 when subsequently stabbed into the packer 18.

Accordingly, it was desirable to create a system where polished bores such as 22 could be protected and particularly in cases where, as illustrated in FIGS. 1 and 2, a liner assembly is to be placed in a wellbore in combination with an external packer, such as packer 18. It was determined to be disadvantageous to provide a sealing contact between the junk cover 32 and the bore 22. Pressure build-up could adversely affect the structure of bore 22 and misshape it to the point of precluding subsequent operations or a subsequent sealing contact therewith.

In a different context of downhole operations, junk covers with seals have been attempted to eliminate the entry of debris. A paper presented at the 1994 Offshore Technology Conference and reprinted in the Sep. 12, 1994, issue of the *Oil & Gas Journal*, entitled "Floating Junk Bonnet Protects Liner Top From Debris," written by Teller and Sweeney, illustrates such a complex design involving numerous seals for the junk cover. This design requires compensation systems for pressure release and prevention of fluid locks so that the tool can be removed. Additionally, this tool did not address the issue of setting a downhole tool such as a liner packer while blocking entry of debris. It further did not address the need to configure the components in such a way so as to minimize or eliminate damage to the polished bore 22 from the setting or testing operations undertaken before the onset of cementing.

With that background, it is one of the objects of the invention to provide a connection from a setting assembly into a packer-setting sleeve so that debris is kept out while damage to the polished bore is reduced, if not eliminated. It is another object of the invention to provide a simple design which can eliminate the separate junk cover, such as 32, and packer setting assembly 28, and replace them with a simple system which allows for setting the packer 18 while meeting the objectives of elimination of debris and wear on the polished bore, such as 22.

SUMMARY OF THE INVENTION

An apparatus is disclosed to allow efficient setting and release from a liner packer connected to a liner assembly. The polished bore adjacent the packer is protected from debris since the setting procedure takes place while the polished bore remains protected. Movements necessary to accomplish the setting procedure occur principally at the uphole end of the polished bore to minimize adverse effects on the integrity of the polished bore from such movements in an area where subsequent operations require a sealing contact.

DETAILED DESCRIPTION OF THE PREFERRED EMBODIMENT

Figure 3A:
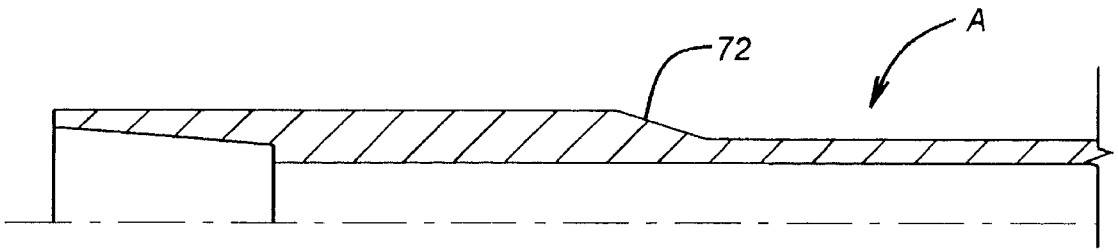
FIG. 3*a–c* is a sectional elevational view of the apparatus of the present invention in the run-in position.
Figure 3B:
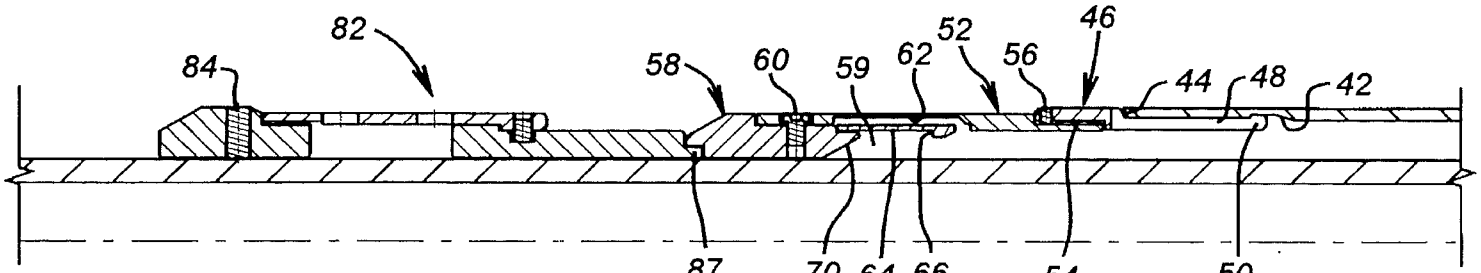
Figure 3C:
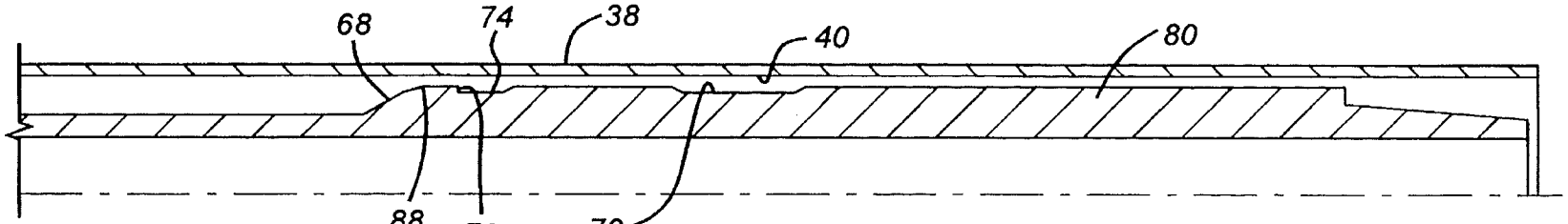

The apparatus A of the present invention is illustrated in FIG. 3. Typically, a packer (not shown in FIG. 3) has a setting sleeve 38 extending therefrom. The setting sleeve 38 has a polished bore 40. Adjacent the upper end of polished bore 40 is a groove 42. The setting sleeve 38 terminates at upper end 44. For the run-in operation, the setting sleeve 38 is supported by ring 46, which has a plurality of collets or fingers 48, each terminating in an outwardly oriented shoulder 50, which is engaged in groove 42. Those skilled in the art will appreciate that the proportions and dimensions of shoulder 50 and collets 48, as well as groove 42, can dictate the necessary pulling force to be applied to separate the setting sleeve 38 from the ring 46. Ring 46 is connected to ring 52 at thread 54. Thread 54 is secured by set screw 56. Ring 52 is secured to ring 58. Connector 60 connects ring 52 to ring 58. Rings 46, 52, and 58, along with flexible ring 64, comprise a latching mechanism which ultimately selectively secures mandrel 72 to sleeve 38. Ring 58 effectively covers an annular space 59 between mandrel 72 and sleeve 38, as extended by rings 46 and 52, throughout the motions shown in FIGS. 3–6 until release. Ring 52 has a recessed surface 62. Ring 58 has a flexible expandable ring 64 which has on it one or more inwardly oriented shoulders 66. It is temporarily retained to ring 58 by a built-in bias directed radially inwardly toward a shoulder on ring 58. As shown in FIG. 3*b*, the expanding ring 64 is substantially parallel to recess surface 62 and is sufficiently set back to allow tapered surface 68 to be moved toward tapered surface 70, as shown by comparing FIG. 3*b–c* to FIG. 4*b*.

An inner mandrel 72 extends through rings 46, 52, and 58 and further into setting sleeve 38. Mandrel 72 includes taper 68 which leads to groove 74. Groove 74 has an outwardly oriented shoulder 76, which ultimately catches shoulder 66 on ring 64, and pulls ring 64 with respect to ring 58 as it collapses due to its built-in bias into groove 74, as shown in FIGS. 4*b* and 5*c*. A second groove or depression 78 is generally longer than groove 74 and is longer than the length of collets 48 so that when juxtaposed adjacent collets 48, as shown in FIG. 4*b*, continues to leave the collets 48 unsupported so that a predetermined force, such as 10,000–15,000 lbs., on mandrel 72 will result in release of shoulder 50 from groove 42, as will be explained below.

Figure 2A:
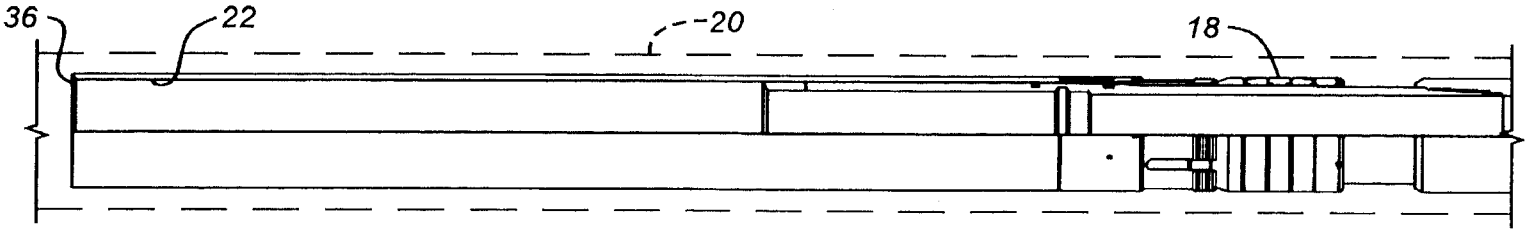
FIG. 2*a–c* is a prior art design of a liner string into which the setting tool of FIG. 1 is insertable for ultimately setting a liner hanger and packer.
Figure 2B:
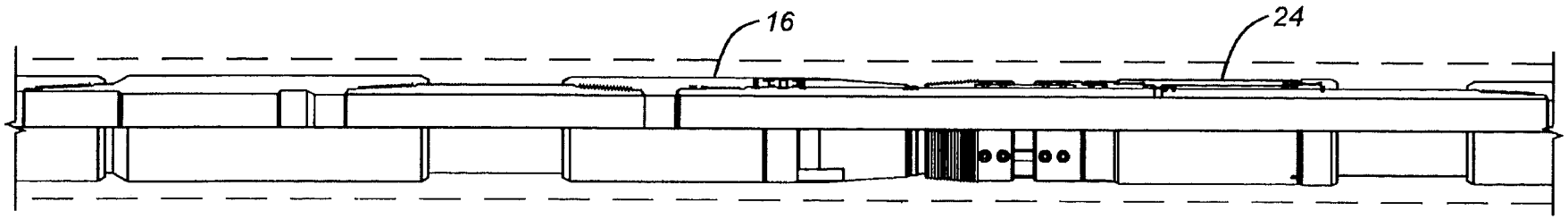
Figure 2C:
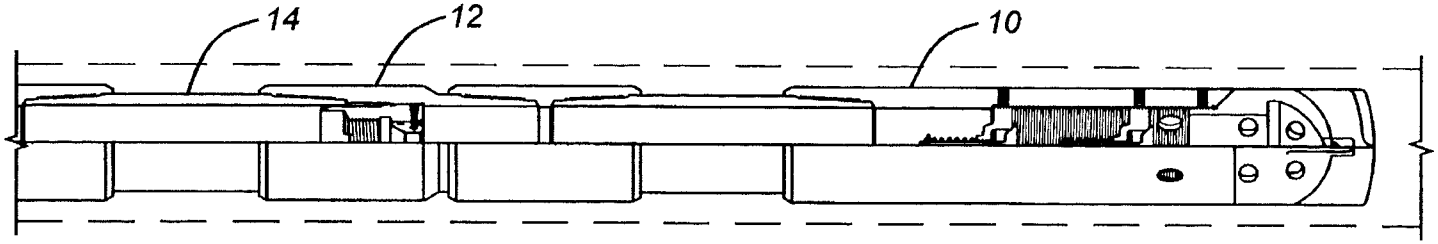

Mandrel 72 has a lower end 80, onto which the remaining known setting assembly components may be attached. Ultimately, the lower end 80 is secured into the packer (not shown), which forms a part of the liner string, similar to the outline illustrated in FIG. 2 of the prior art. The assembly of the apparatus A as shown in FIG. 3 is suitable for setting a packer for the liner string in the traditional manner by relative movement which requires a movement of sleeve 38 with respect to the body of a packer to which it is attached. The apparatus A can also be used with other downhole tools that can be actuated by similar movements. It should be noted that for the run-in position, the mandrel 72, through its lower end 80, is secured to the packer body to prevent relative movement, which may result in premature setting of the packer (not shown). However, once the proper location downhole is obtained, the mandrel 72 is freed from connection to the packer body. It should also be noted that in the run-in position, there is no contact between the polished bore 40 and the components of mandrel 72 down to its lower end 80. An assembly of rings generally referred to as 82 is secured to the mandrel 72 by set screw or equivalent 84. Rings 82 have a lower end 87 which abuts ring 58 in the run-in position, as shown in FIG. 3*b*. Rings 82 can be used with certain designs that may require a set down force on sleeve 38 to get initial release of mandrel 72 from the packer (not shown).

The major components of the apparatus A now having been described, the operation will be reviewed in more detail. The apparatus A is run into the well-bore attached to the setting sleeve 38, as well as the packer (not shown). When the proper positioning is attained, the mandrel 72 is raised upwardly, bringing taper 68 initially against expanding ring 64. Expanding ring 64 in the preferred embodiment is a slotted annularly shaped member that is capable of outward radial expansion against a built-in bias to expand as surface 88, adjacent to taper 68, goes by. As mandrel 72 continues to go up, as illustrated in FIG. 4*b*, the expanding ring 64 is expanded as surface 88 comes under it. It takes a pulling force of about 1,000–5,000 lbs. to expand ring 64. Eventually, surface 88 goes by expanding ring 64 and the ring 64 springs back down into groove 74 on mandrel 72, as shown in FIG. 4*b*. The mandrel 72 is now latched to rings 46, 52, and 58. An upward force at this time will meet resistance since it takes 10,000–15,000 lbs. of force to dislodge shoulder 50 from groove 42. Without exceeding this force, a signal that the tool is ready to set the packer is provided from memory as upward pull which meets resistance. A subsequent set down force on mandrel 72, as shown in FIG. 5*a–c*, brings mandrel 72 down which in turn puts a bearing load on upper end 44 of setting sleeve 38. As a result, mandrel 72 moves in tandem with setting sleeve 38, as shown in FIG. 5*c*. At this time, groove 78 remains disposed opposite collets 48. However, the compressive load applied to upper end 44 is transmitted longitudinally to setting sleeve 38, while the shoulder 50 remains in groove 42. As shown in FIG. 5, the relative position of rings 82 to mandrel 72 remains unchanged due to their direct connection. Rings 82 moved away from ring 58 when mandrel 72 was moved upwardly, bringing tapered surfaces 68 and 70 together. However, because shoulders 66 and 76 have engaged, downward set down force applied to mandrel 72 moves ring 58 in tandem with rings 82 as the setting sleeve 38 is pushed downwardly through a force transmitted by shoulder 76 of mandrel 72. In effect, expanding ring 64 becomes trapped, as shown in FIG. 5*c*, between shoulders 76 and 90. Shoulder 90 is disposed on ring 52 adjacent recessed surface 62. Expanding ring 64 may also move somewhat with respect to ring 58 due to contact with shoulder 76.

Figure 4A:
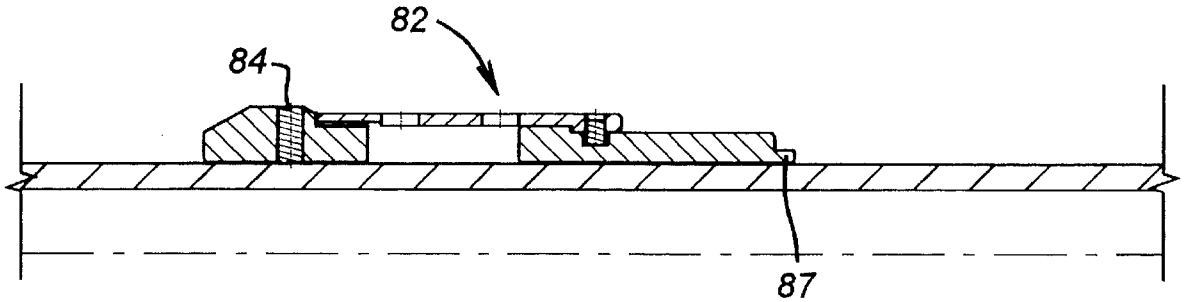
FIG. 4*a–b* is the tool shown in FIG. 3*a–c* in the latched position.
Figure 4B:
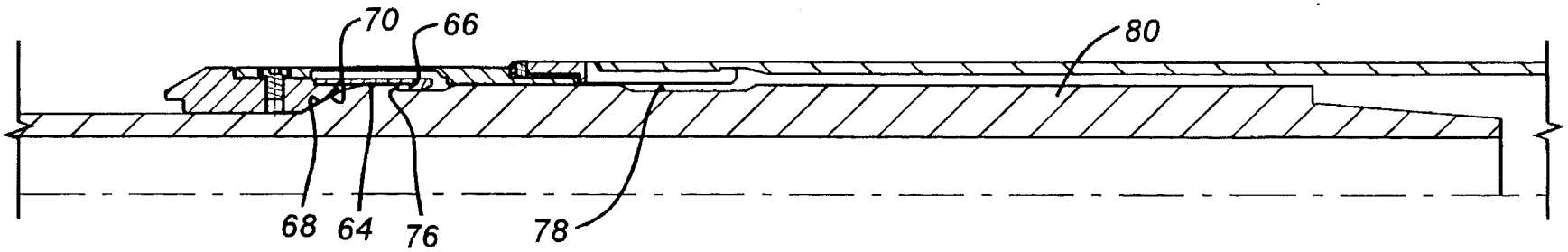
Figure 5A:
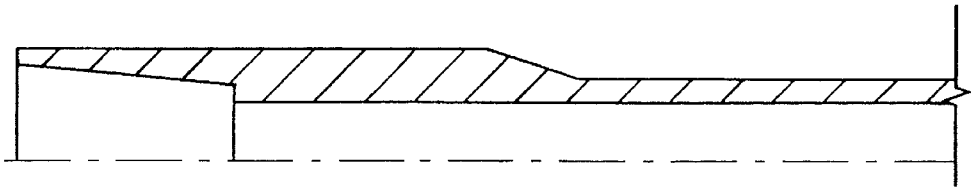
FIG. 5*a–c* is the tool of FIG. 4*a–b* in the set position.
Figure 5B:
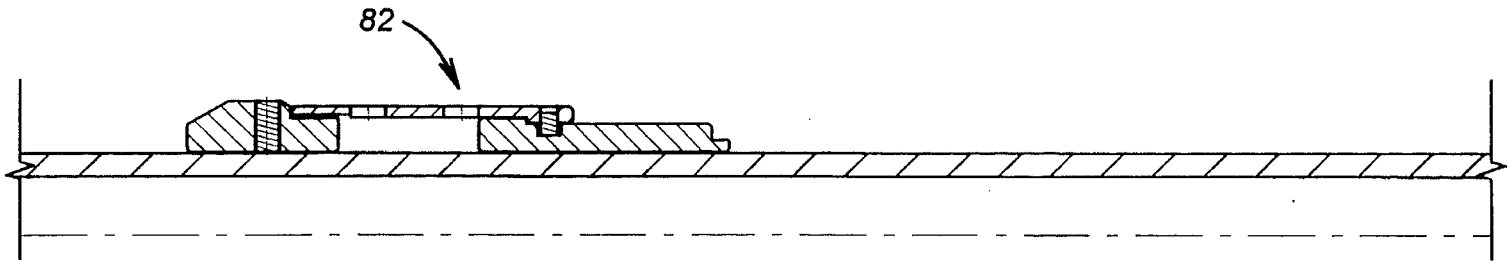
Figure 5C:
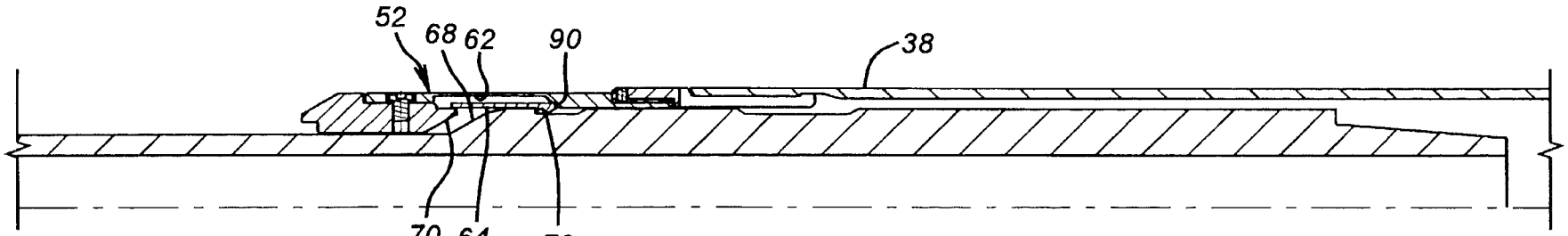
Figure 6A:
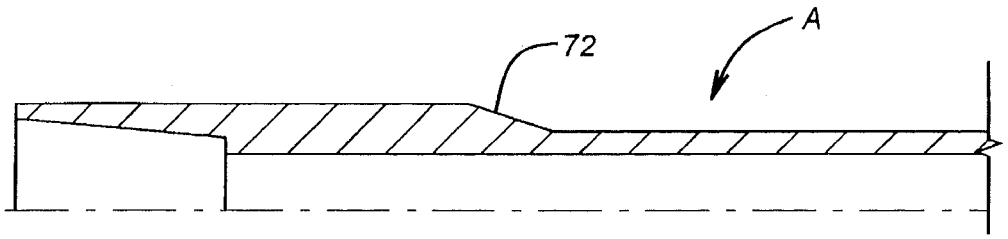
FIG. 6*a–d* is the tool of FIG. 5*a–c* in the released position.
Figure 6B:
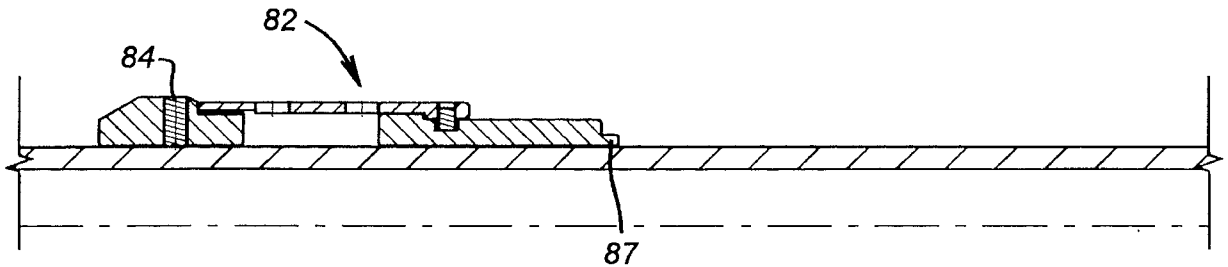
Figure 6C:
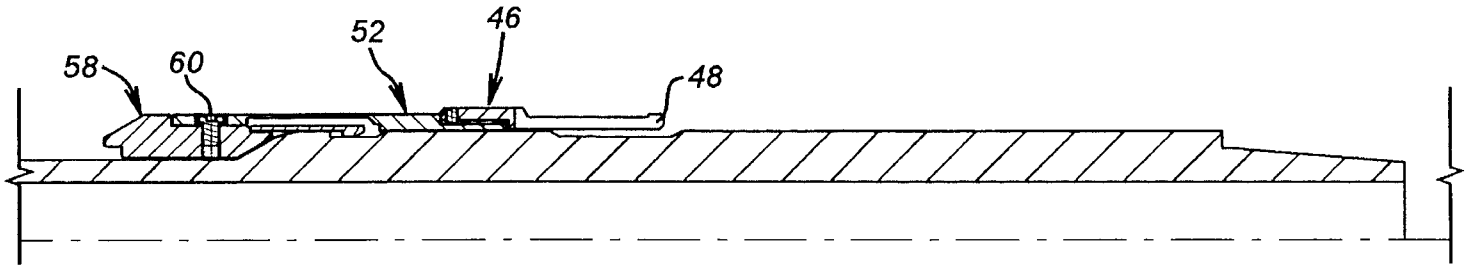
Figure 6D:
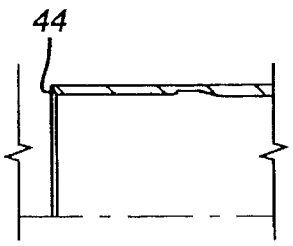

It should also be noted that taper 70, which is ultimately connected to the collets 48 which are engaged in groove 42, acts as a travel stop upon upward motion of mandrel 72, as shown in FIG. 4*a–b*. Prior to applying tie set down force which sets the packer, an upward force can be applied from the surface on mandrel 72 against shoulder 50 in groove 42. Since the pullout force is about 10,000–15,000 lbs., the resistance to a lessor upward force is a signal that the packer will set upon a let down force. Upon application of a set down force on mandrel 72, taper 68 moves away from tapered surface 70 (see FIG. 5*c*).

At the conclusion of the movements shown in FIG. 5*a–c*, the packer (not shown) is set and the final step is to disengage the running tool assembly from the setting sleeve 38. In order to accomplish that, an upward force is applied to mandrel 72. When a predetermined force, generally in the order of 10,000–15,000 lbs. is exceeded, the shoulder 50 comes out of groove 42 and springs radially inwardly into groove or depression 78, which opposes collet 48 at that time. FIG. 6*a–d* shows the conclusion of the release procedure where the collet heads 48 have sprung back outwardly after clearing the upper end 44 of the setting sleeve 38.

Those skilled in the art will appreciate that the only contact of the mandrel 72, and the components attached to it, with the polished bore 40 of setting sleeve 38 is the initial engagement of collet 48 in groove 42. All the other engagements of the mandrel 72, such as those involving the surface 76 adjacent groove 74, occur outside the setting sleeve 38.

It is further evident by the above description of the apparatus A of the present invention that with the configuration described in FIGS. 3–6, debris is kept out of polished bore 40. This is because throughout the manipulations described in FIGS. 3–6, ring 58 effectively circumscribes mandrel 72 in a manner so as to keep debris from the wellbore from passing beyond and into polished bore 40, where it can do some damage not only to the honed surface but also cause mechanical failures of components mounted to lower end 80. In effect, the design of the apparatus A of the present invention replaces the spring-loaded dogs 30 and the overall packer setting assembly 28, illustrated in FIG. 3, as well as the junk cover 32 used in combination with it. Now, using the configuration as illustrated, debris is effectively eliminated from the honed bore 40. It should be noted that positive sealing elements are not employed in ring 58 so as to potentially subject the setting sleeve 38 to differential pressures which could cause its collapse inwardly and/or outwardly and thus cause a malfunction of the setting assembly. Keeping a close clearance between ring 58 and the outer diameter of the mandrel 72 suffices to exclude debris while at the same time precluding the potential for trapping pressure on one side of the setting sleeve 38, which could cause the bowing and/or buckling situation. However, seals can be incorporated for a particular application if measures are taken to prevent excess pressure differentials.

It should be noted that the ring assembly 82 can be optionally used if, as part of the release procedure, a set down force on setting sleeve 38 is required. The ring assembly 82, through its lower end 87, applies the set down force through rings 46, 52, and 58 into upper end 44 of setting sleeve 38.

The design of the apparatus A is a simple and efficient way to eliminate more complex parts used in the prior art which tended to mar or deface the honed bore 40. With the new arrangement of parts, all the movement is restricted to adjacent the upper end 44 of the setting sleeve 38, while the only contact with the honed bore 40 occurs beginning at groove 42 and ending at the upper end 44 or the upper zone. As a result, further down honed bore 40, in the lower zone where subsequent equipment is installed with seals, a sealing integrity can be assured because mechanical components have not had to be moved longitudinally or even rotationally while in contact with honed bore 40. Finally, the components remain interengaged when in the position shown in FIG. 5*c* after the packer has been set so that any upward forces on the setting string, experienced during cementing, do not inadvertently expose the honed bore 40 to debris as could have occurred in prior designs when the dogs 30 are merely resting on upper end 36 of the setting sleeve for the packer 18.

The foregoing disclosure and description of the invention are illustrative and explanatory thereof, and various changes in the size, shape and materials, as well as in the details of the illustrated construction, may be made without departing from the spirit of the invention.

I claim:

1. An apparatus for actuating a downhole tool by movement of a setting sleeve, comprising:

a setting sleeve on the downhole tool;

a setting mandrel selectively movable with respect to said sleeve;

a latching mechanism to releasably secure said mandrel to said sleeve;

said mandrel disposed within said sleeve and defining an annular space therebetween, said latching mechanism effectively occupying said annular space during movement of said mandrel in a manner so as to reduce the possibility of entry of wellbore debris into said annular space during movement of said mandrel to actuate said sleeve.

2. The apparatus of claim 1, wherein:

said latching mechanism circumscribes said mandrel and is releasably secured to said sleeve.

3. The apparatus of claim 2, further comprising:

at least one groove on said sleeve adjacent one end thereof;

said latching mechanism further comprises a first flexible member extending into said groove and removable from said groove on application of a predetermined force.

4. The apparatus of claim 1, wherein:

said mandrel is movable within said sleeve without contact therewith in said annular space.

5. The apparatus of claim 3, wherein:

movement of said mandrel in a first direction with respect to said latching mechanism secures said latching mechanism to said mandrel.

6. The apparatus of claim 5, further comprising:

a second flexible member on said latching mechanism, said second flexible member engaging said mandrel upon movement of said mandrel into initial contact therewith.

7. The apparatus of claim 6, wherein:

said second flexible member is initially moved in one direction and subsequently snaps back in the opposite direction to engage against a surface irregularity on said mandrel.

8. The apparatus of claim 7, wherein:

said surface irregularity comprises a groove on said mandrel;

said second flexible member comprises a ring having at least one latching collet thereon which snaps into said groove on said mandrel, whereupon reversal of motion of said mandrel said latching collet is trapped between said mandrel and said latching mechanism for transmission of force to said first flexible member.

9. The apparatus of claim 8, wherein:

said mandrel further comprises a cam to flex said latching collet sufficiently to allow it to snap back into said groove on said mandrel;

said latching mechanism acting as a travel stop for said cam when said first flexible member is disposed in said groove on said sleeve.

10. The apparatus of claim 7, wherein:

said first flexible member further comprises at least one setting collet;

said mandrel comprising a depression which is positioned opposite said setting collet when said latching collet is disposed in said groove on said mandrel.

11. The apparatus of claim 10, wherein:

said latching mechanism acts as a travel stop preventing escape of said latching collet from said groove when said setting collet is positioned in said groove in said sleeve;

said setting collet flexing into said depression on application of a predetermined force to release from said groove on said sleeve, whereupon actuation of said sleeve and application of said predetermined force to flex said setting collet, said mandrel supports said latching and setting collet for removal from said annular space in said sleeve.

12. The apparatus of claim 10, wherein:

said groove on said sleeve is disposed adjacent said end of said sleeve farthest from the downhole tool, defining an internal upper zone from said groove away from the downhole tool and an internal lower zone from said groove adjacent the downhole tool;

said setting collet engaging said sleeve internally only in said groove and upper zone, while neither the balance of said latching mechanism or said mandrel contacts said sleeve in said lower zone, thereby preventing damage to the sleeve in said lower zone during movements of said mandrel or said latching mechanism.

13. A method of keeping debris out of a setting sleeve for a downhole packer, comprising:

engaging a setting tool to a sleeve;

lowering the sleeve into position in a wellbore;

substantially closing off an annular space between said setting tool and the sleeve during manipulation of the setting tool;

setting the packer while maintaining said annular space substantially closed off;

releasing from said sleeve;

removing the setting tool from said sleeve.

14. The method of claim 13, further comprising:

locating said groove on said sleeve adjacent an end opposite the packer;

completing setting the packer and releasing from said sleeve without internal contact of said sleeve between said groove and the packer by said setting tool.

15. The method of claim 14, further comprising:

polishing the internal surface of said sleeve between said groove and the packer;

maintaining the integrity of said polished surface while setting the packer and release from said sleeve by avoidance of contact from said setting tool.

16. The method of claim 13, further comprising:

providing a mandrel extending through a latching mechanism as said setting tool;

positioning said latching tool to be supported by said sleeve while covering said annular space between said mandrel and said sleeve.

17. The method of claim 16, further comprising:

using a first flexible member on said latching mechanism to engage a groove on said sleeve, said groove located adjacent the end of said sleeve remote from the packer;

moving said mandrel with respect to said flexible member;

securing said mandrel to said latching mechanism by said relative movement.

18. The method of claim 17, further comprising:

driving said sleeve with said mandrel after securing them together through said latching mechanism;

positioning a recessed area of said mandrel opposed to said first releasable member when said mandrel is secured to said latching mechanism.

19. The method of claim 18, further comprising:

applying a predetermined extraction force to said mandrel;

flexing said first flexible member out of said groove in said sleeve and toward said recessed area;

removing said mandrel while said latching mechanism is still secured to it as an assembly from said sleeve.

20. The method of claim 17, further comprising:

providing a second flexible member on said latching mechanism;

camming said second flexible member with said mandrel;

providing a recess on said mandrel;

allowing said second flexible member to enter said recess after camming to secure said mandrel to said latching mechanism.

21. The method of claim 20, further comprising:

providing a mounting ring to support said second flexible member;

retaining said mounting ring to said sleeve via said first flexible member while it extends in said groove in said sleeve;

using said mounting ring as a travel stop for said cam on said mandrel;

providing at least one collet as said second flexible member which aligns with said recess on said mandrel when said cam travel is stopped by said ring.

22. The method of claim 21, further comprising:

trapping said collet in part in said recess;

transmitting a setting force through said collet to said first flexible member to shift said sleeve to set the packer.

23. The method of claim 22, further comprising:

allowing said first flexible member to bear on an end of said sleeve for pushing it to set the packer;

configuring at least one collet on said first flexible member to engage said groove on said sleeve.

24. The method of claim 16, further comprising:

configuring a portion of said latching mechanism as an annular member circumscribing said mandrel;

positioning said annular member adjacent said mandrel such that it substantially covers said annular space during manipulation of said mandrel to set the packer.

25. The method of claim 6, wherein:

upon engagement of said second flexible member an upward force against said first flexible member below said predetermined force required to remove said first flexible member from said groove, acts as a signal at the surface that setting down weight thereafter will actuate the downhole tool.

26. The method of claim 20, further comprising:

applying a predetermined test force on said mandrel when said mandrel is second to said catching mechanisms which force is less than the force required for said flexing of said first flexible member off of said groove;

measuring said predetermined test force at the well surface;

using said measurement of said test force as an indication that the packer will be set on subsequent set down of weight on said mandrel.

* * * * *

UNITED STATES PATENT AND TRADEMARK OFFICE

CERTIFICATE OF CORRECTION

PATENT NO. : 5,582,253
DATED : Dec. 10, 1996
INVENTOR(S) : Fraser

Figure 1A:
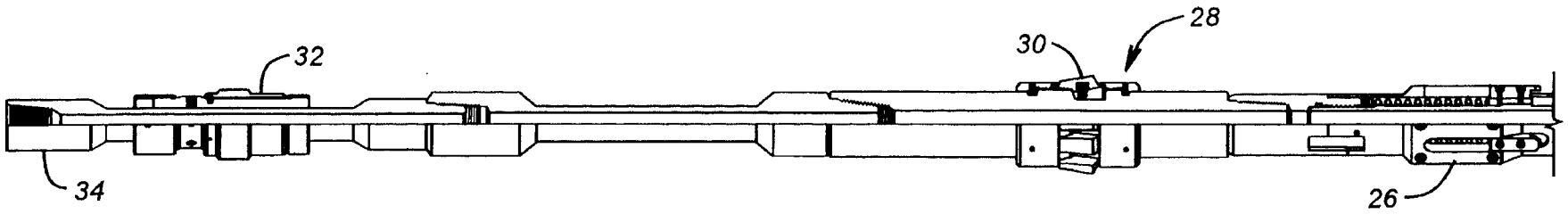
FIG. 1*a–b* is an assembly drawing in section of a setting tool of the prior art.
Figure 1B:
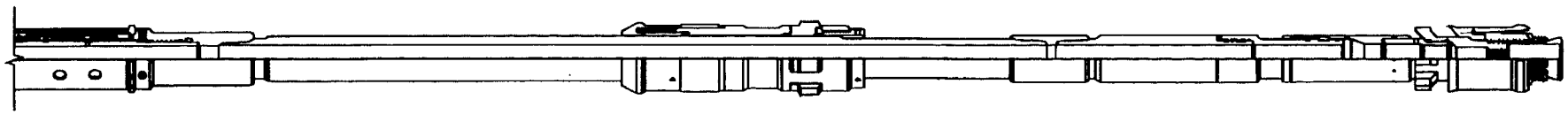

It is certified that error appears in the above-identified patent and that said Letters Patent is hereby corrected as shown below:

col. 4, line 35, delete "from memory as" and insert -- as an --.

col. 4, line 60, delete "tie" and insert -- the --.

col. 4, line 64, delete "lessor" and insert -- lesser --.

col. 5, line 28, delete "Fig. 3" and insert -- Fig. 1b --.

Signed and Sealed this

Twenty-sixth Day of January, 1999

*Attest:*

*Attesting Officer*

*Acting Commissioner of Patents and Trademarks*